United States Patent [19]

Clemens

[11] 4,066,802

[45] Jan. 3, 1978

[54] COLORED XEROGRAPHIC IMAGE TRANSFER PROCESS

[75] Inventor: Carl F. Clemens, Ontario, N.Y.

[73] Assignee: Xerox Corporation, Stamford, Conn.

[21] Appl. No.: 643,067

[22] Filed: Dec. 22, 1975

[51] Int. Cl.[2] ..... B44C 1/16; G03G 13/16

[52] U.S. Cl. ..... 427/24; 156/230; 156/235; 156/237; 156/240; 427/148

[58] Field of Search ..... 427/148, 146, 24, 16; 156/230, 235, 237, 240

[56] References Cited

U.S. PATENT DOCUMENTS

| | | | |
|---|---|---|---|
| 2,855,324 | 10/1958 | Van Dorn | 117/25 |
| 2,886,464 | 5/1959 | Van Dorn | 117/17.5 |
| 3,386,847 | 6/1968 | McDermott et al. | 117/36.4 |
| 3,658,519 | 4/1972 | Menz | 96/1.4 |
| 3,799,827 | 3/1974 | Takimoto et al. | 156/219 |
| 3,833,293 | 9/1974 | Serio et al. | 355/17 |
| 3,854,942 | 12/1974 | Akman | 96/1.2 |

*Primary Examiner*—James R. Hoffman

*Attorney, Agent, or Firm*—James J. Ralabate; Donald C. Kolasch; Paul A. Leipold

[57] ABSTRACT

A method of decalcomania in which a toner image pattern is formed on a transfer member which has been overcoated with an abhesive material. A polymeric sheet is interposed between the toner image and a cloth or other image receiving medium. The polymeric sheet assists in the permanent adherence of the toner imaging pattern to the cloth material or other medium when the composite is subjected to heat and pressure. The transfer member and method of its use are set forth. Another embodiment discloses the use of solvent to fix the image to a cloth material.

16 Claims, 6 Drawing Figures

COLORED XEROGRAPHIC IMAGE TRANSFER PROCESS

BACKGROUND OF THE INVENTION

This invention relates to xerographic reproduction and specifically to a method of transferring xerographically reproduced images to cloth materials or other substrates to form permanent images. A method of forming xerographically reproduced permanent images on cloth would be useful as it would allow low-cost production of images on cloth for personalization of articles and formation of low-cost decorated clothing, household goods, decorative items, draperies or furniture. The formation of images on cloth heretofore could only be performed by expensive silk screening operations or by transfer of materials such as decals onto cloth. Even in the case of decals, while they allow a large variety of messages and images, there is still the limitation that the decals need to be separately formed usually in large quantity and do not allow the maker of the decorative item to personalize the decoration to any great extent. Therefore, an easy and inexpensive means for the production of images on cloth has been sought whereby any pictures or messages on paper could be reproduced on cloth cheaply and accurately.

The advent of xerography and electrostatic copying as generally disclosed by Carlson in U.S. Pat. No. 2,297,691 has proven to be a highly successful process for reproduction with the inherent advantages of speed and reliability. In a usual xerographic process, an electrostatic image on an object is formed on a recording member such as a xerographic plate or drum. The xerographic plate may comprise a layer of photoconductive material, such as selenium on a conductive metal backing. The latent electrostatic image which is formed on the photoconductive material is developed into a powder image which is then subsequently transferred on a sheet of paper and affixed thereon to form a permanent print.

The xerographic process has therefore proven to be an easy and reliable means for the production of transparencies. Transparencies made by a xerographic process are produced by forming an electrostatic image of the desired object, developing it, and then transferring it to a transparent sheet material with the image being permanently affixed or fused thereto by either the application of heat or by the action of a solvent vapor. In either case the toner which is used to develop the powdered image is coalesced on the sheet material by the fusing technique to form a permanent image thereon. Solvent fusion techniques for transparent materials made by a xerographic process, for example, are illustrated in U.S. Pat. Nos. 3,049,810 and 3,148,078.

While the xerographic reproduction process is an apparent solution to the problem of economical and efficient production of cheap, individualized images on cloth, other problems have been encountered with its use in the production of such images. One of the most pronounced problems with producing cloth images or images on mediums such as polymer sheets from xerographically produced images is the failure of the toner powder or developed toner image to adhere well to the cloth material. Images produced xerographically and then transferred to paper are generally fixed to paper by the action of heat and pressure within the copying machine. However, there are problems with the feeding of cloth or garments in a xerographic machine and further there are problems in transfer of the powder image to a cloth material. It has been proposed that a fused colored xerographic toner image produced on a paper having a release coating be transferred to cloth by the action of heat and pressure to result in the transfer of the image to the cloth. However, such an image is not satisfactory as it does not have resistance to washing and has a tendency to crack when the cloth is flexed.

SUMMARY OF THE INVENTION

It is therefore an object of this invention to provide a method of imaging overcoming the above-noted deficiencies.

It is another object of this invention to provide clear, high resolution color images on cloth.

It is a further object of this invention to provide a method of fixing colored images to cloth.

It is an additional object of this invention to provide low-cost individual images on cloth.

It is a still further object of this invention to provide long lasting and xerographically produced images on cloth.

It is again an object of this invention to provide a method of fixing xerographic images to cloth.

It is a further additional object of this invention to provide a method of storing and shipping xerographically produced toner images prior to their transfer to cloth.

It is an object of this invention to provide a substrate onto which xerographic images may be transferred for later permanent transfer to cloth.

It is also an object of the present invention to provide for production of color images on cloth by xerographic color imaging process which in turn eliminates the skill of a technican who is trained in reproduction photographic processing.

It is an additional object of the present invention, therefore, to provide for an image on cloth or other substrate which is a multi-colored xerographic image permanently affixed with uniform and constant color reproduction, density and permanence.

It is an additional object to provide permanent xerographic images on wood or polymer sheet material.

The above objects and others are accomplished generally by providing an abhesive coated sheet onto which toner is transferred in the copying machine. The toner image may then be transferred by heat to form with an interposed polymeric or plasticizing sheet a permanent image on cloth. The interposed sheet material comprises a layer of material which promotes transfer and adherence of toner to cloth under heat and pressure but forms a sheet at ordinary temperatures. The polymeric or plasticizing material may be applied directly to the toner image formed on the abhesive coated substrate or may be placed on the cloth and the image bearing surface brought into face to face contact there. The invention further encompasses wherein the toner is transferred to a polymeric sheet and then the polymeric sheet on which the toner rests is treated by solvent or heat to affect the transfer and permanent adherence of the toner to cloth material. In another embodiment of the invention, a heated roller is utilized to fix toner to a cloth substrate. In still another embodiment, solvent vapor is used to fix toner to cloth. In still an additional embodiment, the invention encompasses the formation of permanent images on polymeric sheet material.

BRIEF DESCRIPTION OF THE DRAWINGS

The advantages of the improved method of transfer of toner images to cloth will become even further apparent upon consideration of the following disclosure of the invention particularly when taken in conjunction with the accompanying drawings wherein.

DETAILED DESCRIPTION OF THE DRAWINGS

Figure 1:
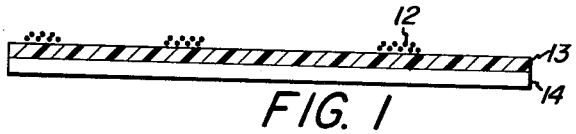
FIG. 1 is a cross section of one image transfer member in accordance with the invention.

FIG. 1 represents an image bearing abhesive coated sheet which may be used in the processes of the invention. Substrate 14 supports the layer of silicone resin or other abhesive release material 13 on which rests an image composed of toner 12 which is composed of colorant material and a resin.

Figure 2:
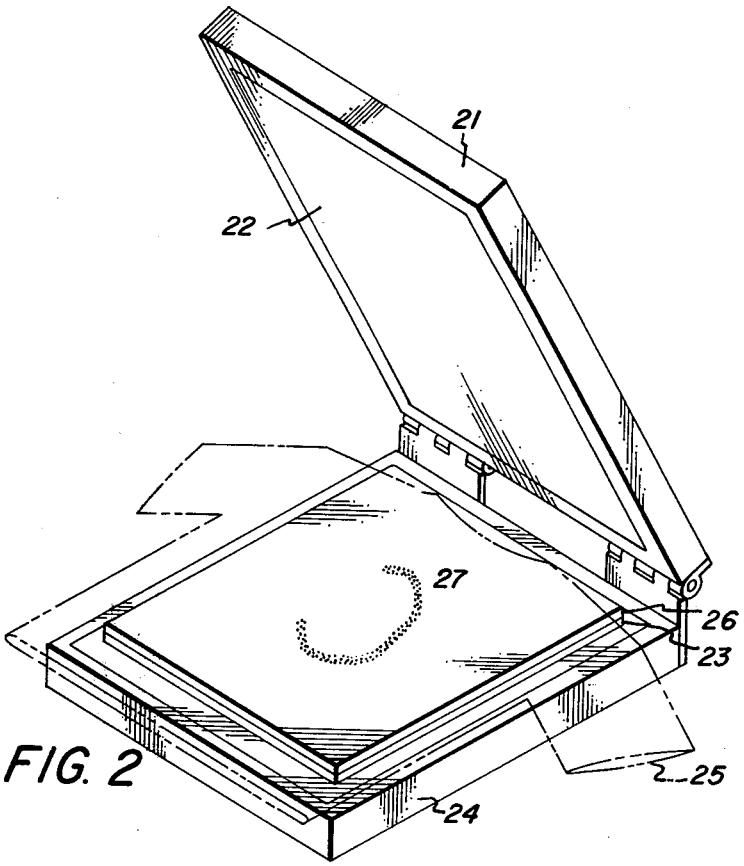
FIG. 2 represents apparatus used to bind toner material to a cloth article.
Figure 3:
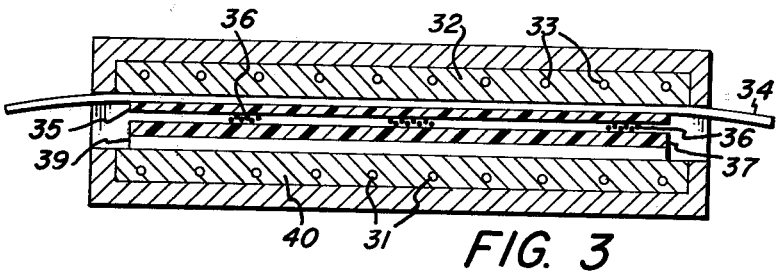
FIG. 3 represents a cross section of the apparatus of FIG. 2 when in use for the process of this invention.

FIG. 2 represents a device for transferring the substrate bearing a toner image as illustrated in FIG. 1 to a cloth material. The cloth represented by shirt 25 is placed on the lower member 24 of the heated platen represented by 21. The transfer sheet 23 has been placed on the lower platen with the toner image 27 facing toward the cloth. An interposed polymeric sheet 26 has been placed over the toner image and the shirt rests over the polymeric interposed sheet. The interposed polymeric sheet may be placed over the unfused or slightly fused toner image immediately after it is formed to form an integral composite or may be placed in contact further in the press. The preferred method is to bring the polymeric sheet into contact with the image immediately after its formation as this assists in preventing movement of the toner image on the substrate. The upper platen 22 is then brought down to effect transfer of the toner image to the cloth by heat and pressure. As illustrated in FIG. 3, which is a cross section of a press in accordance with FIG. 2, the press is closed for transfer of the toner image to the cloth. The press may be heated on one or both platens. The temperature may be controlled by regulation of the heater elements 33 in the upper platen 32 and heating elements 31 in the lower platen 40. The elements in the press effecting transfer of the toner image 36 to the cloth are interposed sheet 35 which overlays toner 36 that rests on abhesive release material 37. The abhesive release material such as silicone rests on a substrate 39 which may be paper or plastic material.

Figure 4:
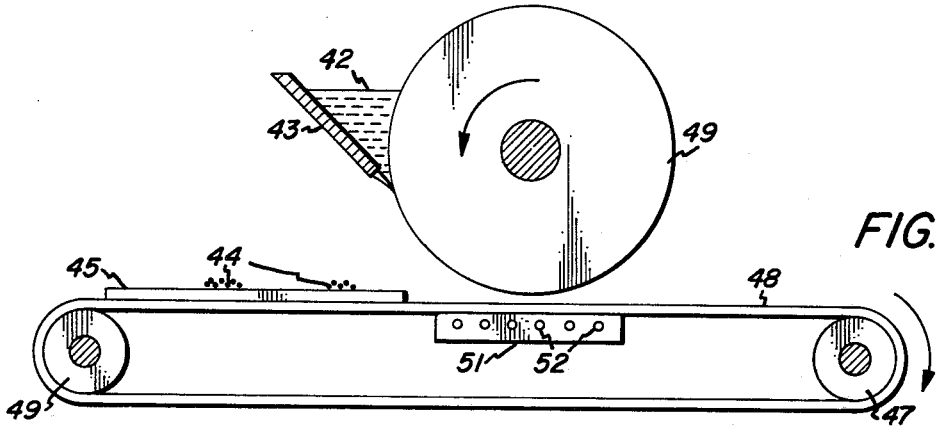
FIG. 4 represents an embodiment of the invention wherein a heated roll is utilized to fuse toner to cloth.

FIG. 4 illustrates a heated roll apparatus used to fix toner material to cloth. The cloth 45 on which rests the toner image 44 is carried by belt 48 beneath heated roll 49. The belt is supported by rollers 46 and 47 that are driven by means not shown. Platen 51 provides a solid base against which the roller may press. The platen may be heated by heaters 52. The heated roll 49 driven by means not shown has applied thereto by means 43 a liquid 42 which serves both as a lubricant and a plasticizer which aids in permanently adhering the toner material 44 to the cloth 45. The roll is heated by internal heating means not shown and may be metal such as copper or aluminum that is surfaced with releasing material, such as silicone or Teflon, or may comprise a metal such as stainless steel or copper.

Figure 5:
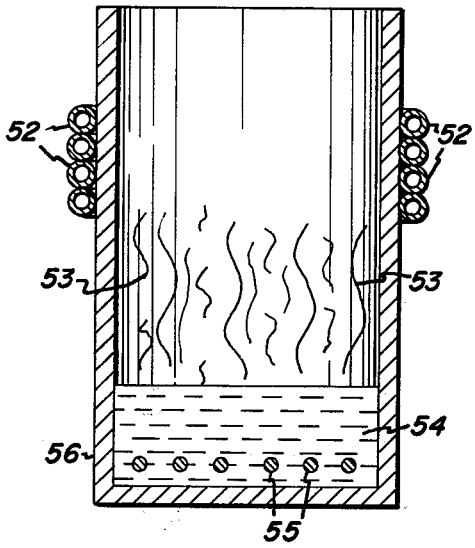
FIG. 5 represents a cross section of an apparatus for solvent fusing in accordance with the invention.

FIG. 5 represents a cylindrical device used for the vapor fusing of colored toner to a cloth substrate. A container 56 holds a liquid 54 which is vaporizable and which is a solvent for the toner material. The vapors 53 are controlled within the device by cooling coils 52 which decrease the likelihood of escape of the vapors. A cloth substrate with a toner image, not shown, is lowered to the level of the vapors to fuse the toner image thereon. Such a device has necessary ventilation devices, not shown, to prevent escape of vapors into the atmosphere and inhalation by the operator of the device.

Figure 6:
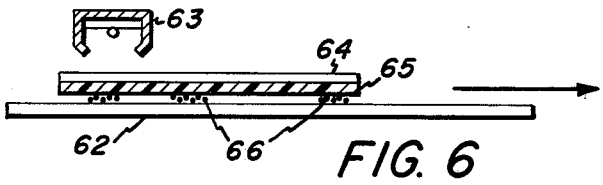
FIG. 6 represents a method of transferring unfused toner to cloth.

FIG. 6 represents a method and device for transferring unfused toner from a substrate to cloth. Substrate 64 bearing an abhesive layer on which rests unfused toner is placed in facing contact with a cloth material 62. A corona 63 deposits a charge of the same sign as that carried by the toner as it is passed over the back of the substrate 64, causing the toner to be repelled from the substrate and deposited on cloth 62. As represented the toner is carried on the silicone coated substrate. Although preferred for more complete transfer, it is not necessary that an abhesive layer be present for transfer when the toner is not fused. It is possible to carry out a transfer from ordinary paper carrying an unfused image. Further, it is possible to place another electrode, not shown, below the cloth and maintaining a charge opposite to that of the toner in order to assist in toner transfer to the cloth. The toner image after transfer to the cloth may be fused by solvent vapors as illustrated in FIG. 5, the heated roller as illustrated in FIG. 4 or placed in a heated press and covered with an interposed polymeric sheet. In the embodiment wherein cloth bearing a toner image is placed in a press, covered with a plasticizing polymer sheet and then heated under pressure, it is necessary that both surfaces of the press be abhesive.

The method of forming full color images by multicolor electrophotographic printing is well known. The method and materials suitable for such process have been disclosed in U.S. Pat. Nos. 3,833,293 and 3,804,619 which are incorporated by reference. Color electrophotography with multiple development techniques is capable of producing color reproductions employing multiple sequencing of electrophotographic charging, exposing and developing steps with colored toners. A suitable photoconductor such as selenium or zinc oxide photoconductive paper is electrostatically charged uniformly in the dark, then exposed through a green filter to an imagewise projection of a color image to form an electrostatic latent image on the photoconductor. The electrostatic latent image is then developed with the complementary magenta colored toner to form a magenta colored image corresponding to said electrostatic latent image and transferred in register to an image receiving member. The photoconductor is then again electrostatically charged uniformly in the dark and then exposed through a red filter to an imagewise projection of a color image in register with said magenta developed image to form a second electrostatic latent image, which said second image is developed with a complementary cyan colored toner and likewise electrostatically uniformly charged in the dark and then exposed through a blue filter to an imagewise projection of a color image in register with said magenta and cyan developed images to form a third electrostatically latent image which is then developed with the complementary yellow toner and again transferred in register. This electrophotographic process with superimposed development to obtain images of cyan, magenta and yellow, respectively, is capable of producing multicolored images by employing toners of different colors. The sequence of exposures to colored filters in this multiple development process may be performed in any suitable sequence other than the green, red and blue sequence recited above. Each developer employed comprises ordinarily a toner or a colored resin mixture in combination with a carrier. The conventional development system is a cascade or magnetic brush development system. When the process of the instant invention is performed, the conventional development and transfer process is performed to transfer the color image comprised of the magenta, cyan and yellow toners onto the member comprising a substrate overcoated with a silicone release material. This member carrying the toner image is then ordinarily removed from the machine without fusing. This may be done by either disconnecting the fuser system, separating the fuser rolls, or removing the fuser entirely.

Toners suitable for the invention include any conventional toner material. Typical of such materials are those disclosed in U.S. Pat. Nos. 3,909,259 and 3,804,619. Preferred toners for use in the invention are those formed from a 65/35 styrene-n-butylmethacrylate copolymer with a colorant present in an amount of from 2 to 8 parts by weight colorant per 100 parts by weight of the resin material. Preferred magenta colorants are tetra-4-(octadecylsulfonamido) phthalocyanine and Colour Index pigment blue 15, C.I. 74160. A preferred magenta colorant is 2,9-dimethyl-quinacridone anthraquinone dye identified in the Colour Index as C.I. 60710, C.I. Disperse Red. Preferred yellow toner colorants are Colour Index Solvent Yellow 29 C.I. 21230 and Colour Index Pigment Yellow 97. The above resin and toner compositions are preferred as these give exceptional brightness, and desirable fixing and transfer characteristics.

The transfer member used in the invention may have as its substrate any suitable material such as paper or plastic. The preferred material is paper due to its low cost and desirable electrostatic properties. The release or abhesive coating overlaying the substrate may be formed of any material which exhibits release properties to resins forming toner and the plasticizing layer. Suitable materials are fluorinated hydrocarbons such as Teflon and silicone release materials which possess suitable abhesive properties and also temperature resistance. A coating comprising melamine formaldehyde and silicone has been found to be suitable.

Typical silicone gums which are of the heat curing or thermally curable type suitable for use in the instant invention include Y-3557 and Y-3602 silicone gums available from Union Carbide Company, New York, New York, as well as #4413 silicone and #4427 heat curable silicone gums available from General Electric Company, Waterford, New York. Other typical materials which are suitable include Dow Corning S2288 silicone gum, available from Dow Corning Corporation, Midland, Michigan. The Y-3557 and Y-3602 gums specifically have aminoalkane cross-linking sites in the polymer backbone which react with a diisocyanate crosslinking agent such as a blocked isocyanate over a wide range of temperature and time to produce a durable toner releasable elastomeric film. The time and temperature relationship for crosslinking of all of these different types of gums is controlled by the chemistry of the crosslinking agent employed and a large choice of agents are available for this purpose. The present invention is therefore not intended to be limited with respect to either time or curing temperature of these materials or the specific materials used to achieve crosslinking, although heating at temperatures between about 50° C and 300° C will typically cure or convert the silicone gum to a toner releasable silicone elastomer. In the event the RTV silicone gums are employed singularly or in a mixture with a thermally curable gum, typical RTV gums which are suitable include RTV-108, 106, 118 silicone gums available from General Electric Company, Silicone Products Division, Waterford, New York. These gums are capable of being cured to a crosslinked state by standing at ambient temperatures and with exposure to the atmosphere. Any of the above described silicone gums are not dependent on having a specific density of crosslink sites on the polymer, these being capable of variation over a wide operative range and the present invention is not intended to be limited in this respect, with the main criteria being the formation of a non-tacky, durable and toner and plasticizer releasable surface by the process of curing the gum.

Other typical silicones which are of the type suitable for the invention are those disclosed in U.S. Pat. No. 3,386,847, which is incorporated by reference. The silicone compound as therein disclosed may be a mixture containing a major fraction of dimethylsiloxane polymers and a minor fraction of methylhydrogensiloxane polymers in a total of about 30 percent by weight, of the mixture, with approximately 70 percent xylene. Other solvent types of emulsion and organic silicones, including those dilutable by water, may be used. The disclosures included in U.S. Pat. No. 2,588,393 are made of reference as teaching, in considerable detail, various combinations of polymers resulting in silicone compounds of the type satisfactory for practicing the instant invention.

The solvent may be an aromatic, such as toluene, or other rapidly evaporable vehicles to make the coating slurry. These vehicles include aliphatics, such as heptane, or chlorinated solvents, such as perchloroethylene. The catalyst can be any of those set out in U.S. Pat. No. 2,588,393, but especially metal salts of an organic acid. The diorgano tin salt of carboxylic acid is preferred.

The interposed sheet may be formed of any suitable polymeric material. A suitable material would be one that serves to transfer and bind the toner material into the cloth under heat and pressure. Such a material ordinarily will plasticize and be compatible with the resin of the toner when both are fluidized by heat. The interposed sheet further is selected so that it becomes flowable at a temperature compatible with the melting temperature of the toner which is used. The interposed sheet ordinarily is colorless so as not to detract from the toner material image which is to be transferred. However, it is possible to add a light colorant material to the sheet, in order to provide a background of a solid color for the toner image. Typical of such polymer materials are vinyl chloride, methylmethacrylate, ethylmethacrylate, butylmethacrylate, vinylidene chloride, and mixtures, blends and copolymers of these materials which are applied from either emulsions, solutions or latexes. Suitable materials for the subject invention are methylmethacrylate-n-butylmethacrylate copolymers, polyvinyl acetate homopolymer emulsions, vinyl chloride homopolymer latexes and vinyl chloride acrylate latexes and combinations of the above and vinyl chloride — vinyl acetate copolymer resins mixed with ethylmethylacrylate polymers. Polyvinyl butyrate is a preferred material as its use results in good image transfer, good fixing and ease of formation.

Cloths or other transfer receiving mediums suitable for use in the invention may be formed of any material to which toner may be affixed. Cloth may be selected from cotton, polyester, wool, nylon, or blends thereof. The term "cloth" also is used to include both woven and nonwoven materials such as felting. The cloth may be in the form of a finished article or as bulk material which is used and subsequently formed into articles. Cloth may be in the form of shirts, pillowcases, sheets, or sizes suitable for forming wall hangings. A preferred material for transfer in the invention is woven cloth of cotton, polyester, or blends thereof.

In utilizing the process of the instant invention for transfer to other mediums than cloth, it is possible to utilize any medium which is not degraded by the heat of the transfer conditions and to which the toner will adhere with the aid of the method of the instant invention. Typical of suitable non-cloth materials are glass, metals such as steel and aluminum, ceramic materials, special purpose papers and polymeric materials formed of polyesters such as polyethylene terephthalate, polycarbonates, acrylonitrile polymers, elastomers such as ABS, butadiene, gutta-percha and polyurethanes. Mediums formed of natural materials such as wood or leather are also of the type suitable for the process of the invention. The composite leather substitutes often of vinyl or polyurethane fiber reinforced such as Corfam and Naugahyde also are a type of material suitable for the process of the invention. A preferred non-cloth transfer receiving medium is polyvinyl chloride sheet material as this material allows good fixing and clear bright images. Further vinyl chloride is preferred as it is suitable for many uses where decoration is desirable such as book covers and shower curtains.

The liquid which is applied to the heated roll in FIG. 4 may be any material which will serve to plasticize and is compatible with the toner. While the roller 49 is illustrated as heated, it is also within the scope of the invention that the roller is not heated but relies totally on the liquid material applied thereto to plasticize the toner and allow it to flow permanently into the cloth. Typical of materials suitable for application to the roller are solvents such as chlorinated solvents including trichloroethane, toluene, Freon, methachloroform and dichloromethane. Such materials, of course, due to evaporation must of necessity be used with adequate ventilation. Other materials which may be applied to the heated roll include plasticizers such as esters, paraffins, phenoxy plasticizers, phthalic acid derivatives, oleates, stearates and mixtures of these materials. Among those preferred for application to a heated roll are low molecular weight polyethylenes such as Allied Chemical Polyethylene Homopolymer 8 and Homopolymer 9 and Petrolitz Bareco Division Polywax 655, Polywax 1000, Polywax 2000 and Polywax E2020 and mixtures thereof which are nonvolatile, result in good fixing for a permanent image over a wide range of operating temperatures and materials. The low molecular weight polyethylenes listed above have the following properties:

TABLE I

| Property | TYPICAL PROPERTIES BARECO Polywax 655 | BARECO Polywax 1000 | BARECO Polywax 2000 | BARECO Polywax E-2020 |
|---|---|---|---|---|
| Melting | 215 | 235 | 267 | 242 |
| Molecular Weight | 700 | 1000 | 2000 | 2000 |
| Density 77° F (25° C) | 0.96 | 0.96 | 0.96 | 0.99 |
| 300° F (149° C) | 0.78 | 0.76 | 0.77 | 0.79 |
| Viscosity 300° F (149° C) | 50 | 74 | 196 | 230 |
| Acid Number | 0 | 0 | 0 | 21 |

TABLE II

TYPICAL PROPERTIES OF A-C POLYETHYLENES AND COPOLYMERS

| Homo-polymers | Softening Point (ASTM E-28) | Hardness dmm (ASTM D-5) | Density g/cc (ASTM D-1505 | Viscosity-cps 140° C (284° C) (Brook-field) | Acid Number mg KOH/g |
|---|---|---|---|---|---|
| 8 & 8A" | 116 240 | 1.0 | 0.93 | 350 | Nil |
| 9 & 9A" | 117 243 | 0.5 | 0.94 | 350 | Nil |

The transfer of the toner to a cloth for fusing with the roller of the invention may be carried out by any conventional method. One method is the method illustrated by FIG. 6 and described above.

The vapor fusing embodiment as illustrated in FIG. 5 may be performed using any suitable liquid. A liquid for this process should be capable of creating vapors at a reasonably low temperature which act as a solvent for toner materials. Solvent materials which are nontoxic, nonflammable, low cost, vaporizable at low temperatures and readily available are desirable. Among toner solvents which are suitable for the vapor fixing method of the invention are chlorinated solvents such as trichloroethylene, trichloroethane toluene, carbon tetrachloride, methachloroform and dichloromethane. The fluorohydrocarbons commonly known by the trademark Freon have been found to be preferred solvents as they vaporize at relatively low temperatures, are nontoxic and are solvent for the primary toner materials. An optimum vapor fusing medium has been found to be Ucon 113 (Union Carbide) and Freon TF (DuPont) whose compositions are respectively dichlorofluordifluorochloroethane and trichlorotrifluoroethane. These materials are found to give particularly good permanent flex resistance, fixing to cloth and have the desirable properties of reasonable cost and low toxicity.

PREFERRED EMBODIMENTS

The following examples further define, describe and compare methods of preparing the transfer members of the invention and in carrying out the process of transfer of images to cloth material or other mediums. Parts and percentages are by weight unless otherwise indicated.

EXAMPLE I

A transfer member is prepared as follows: A paper sheet 10 × 15 inches is film coated using a draw bar with a 10 percent weight solution in benzene of Y-3557 silicone gum available from Union Carbide Company, New York, New York, containing a blocked aromatic diisocyanate, specifically the acetone oxene adduct of toluene-2,4-diisocyanate as a crosslinking agent in an amount of about 0.5 to 1.5 by weight. The coating is allowed to air dry to remove the solvent leaving the layer with a thickness of between about 5 to about 8 microns. The plate is air dried for approximately 20 minutes at room temperature to remove residual traces of solvent. This sheet is then placed in a forced air oven and heated at 175° C for about 2 minutes in order to cure the silicone surface. A sheet is produced from a solution of about 7.0 grams VYNS, a 90 percent vinyl chloride/10 percent vinyl acetate copolymer resin from Union Carbide, and about 3.0 grams of Elvacite 2042, an ethyl methacrylate polymer from DuPont in about 90 grams of methylethyl ketone as a solvent. The coating is applied to a strippable abhesive surface by wire draw down and forced air dried to form a sheet which is then stripped from the forming surface. A Xerox 6500 color copier was set to operate to produce a minimum fused image on the silicone release paper.

The Xerox 6500 color copier utilized in all examples is operated using toners formed of 65/35 styrene-n-butylmethacrylate as the toner resin which is combined with about 2 to about 10 parts of a colorant. The cyan colorant is tetra-4-(octadecylsulfonamido). The magenta colorant is Colour Index Pigment Red 122. The yellow colorant is Colour Index Pigment Yellow 97 generally described in U.S. Pat. No. 2,644,814 and satisfying the formula:

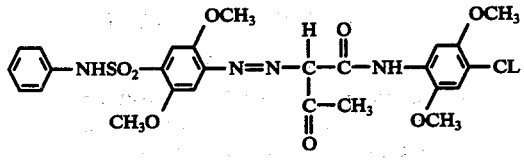

The silicone sheet bearing the slightly fused toner image is then covered with the sheet produced above. This composite of interposed sheet and imaged sheet is placed in a laminating press covered with a piece of cloth and the press closed and held at 350° F to 390° F for 30 seconds. The cloth is formed of a woven cotton and polyester blend having a polyester content of about 50 percent. The press is opened and the paper and cloth removed and allowed to cool to room temperature. The silicone release paper is peeled from the cloth to reveal a uniform almost 100 percent transfer of the image to cloth. The image is totally driven into the cloth through the action of heat, pressure and interposed sheet. The transfer is so complete and totally into the cloth that a backing absorption sheet would be required to prevent toner strike through to the next layer of cloth if present. The cloth is not discolored or otherwise damaged by the plasticizer. The image is not damaged by washing or flexing.

EXAMPLE II

A release paper having a paper substrate coated with a melamine formaldehyde-silicone release coating is provided. About 40 grams VYNS, a vinyl chloride/vinyl acetate copolymer resin from Union Carbide; about 10 grams Lucite 2044, a polymer composed of n-butylmethacrylate; about 4 grams of di-2-ethylhexylphthalate; about 6 grams of diisooctyladipate; about 10 grams of diphenylphthalate; and about 270 grams of methylethyl ketone as a solvent are formed into a sheet material of about 10 micron thickness by wire draw down and forced air dried. The Xerox 6500 color copier is set to operate to produce a minimum fused image on the silicone release paper. The imaged sheet is put into a laminating press covered with the interposed sheet and then with the above sheet the press closed and held at about 350° F for about 30 seconds. The press was opened, the paper and cloth removed and allowed to cool to room temperature. The silicone release paper is peeled from the cloth to reveal a uniform, almost 100 percent transfer of the image to the cloth and the image is driven into the cloth through the action of the heat pressure and plasticizer. The cloth is subjected to flexing and washing with detergents and retains a permanent image.

EXAMPLE III-VII

The silicone coated sheet of Example I is provided. A sheet with a thickness of approximately 0.5 mils is formed by draw down rod on a releasing surface of Teflon in each of the following compositions. After air drying, the sheet is stripped to form the interposed sheet.

| Example | Sheet Forming Compositions |
|---|---|
| III | 7 g. n-butyl methylacrylate<br>3 g. vinyl chloride - acetate copolymer resin<br>(86% vinyl chloride, 14% vinyl acetate)<br>1 g. wetting agent<br>(Armostat 310, Armour Industrial Chemical Co.)<br>90 g. methylethyl ketone and toluene at 1:1 weight ratio |
| IV | 7 g. n-butyl methacrylate<br>3 g. vinyl chloride - acetate - maleic acid polymer resin<br>(86% vinyl chloride, 13% vinyl acetate, 1% maleic acid)<br>1 g. wetting agent<br>(Armostat 310, Armour Industrial Chemical Co.)<br>0.1 g. colloidal silica<br>(Cab-o-Sil, Cabot Corporation)<br>90 g. methylethyl ketone and toluene at 1:1 weight ratio |
| V | 7 g. n-butyl methacrylate<br>3 g. vinyl chloride - acetate - maleic acid polymer resin<br>(83% vinyl chloride, 16% vinyl acetate, 1% maleic acid)<br>1 g. wetting agent<br>(Armostat 310, Armour Industrial Chemical Co.)<br>0.5 g. Carbon Black Pigment<br>90 g. methylethyl ketone and toluene at 1:1 weight ratio |
| VI | 7 g. n-butyl methacrylate<br>3 g. vinyl chloride - acetate - maleic acid polymer resin<br>(81% vinyl chloride, 17% vinyl acetate, 2% maleic acid)<br>1 g. wetting agent<br>(Armostat 310, Armour Industrial Chemical Co.)<br>1 g. Titanium Dioxide<br>90 g. methylethyl ketone and toluene at 1:1 weight ratio |
| VII | 7 g. n-butyl methacrylate<br>3 g. vinyl chloride - acetate copolymer resin<br>(97% vinyl chloride, 3% vinyl acetate)<br>0.5 g. wetting agent<br>(Armostat 310, Armour Industrial Chemical Co.)<br>1 g. Aluminum Flake Pigment<br>90 g. tetrahydrofuran |

The silicone coated sheet is operated in a conventional Xerox 6500 color copier with the fuser off to form a full color image. The imaged sheet is then put into a laminating press, the interposed sheet is placed over the silicone coated sheet carrying the image, and then a cotton cloth is placed over the interposed sheet. The press is closed and held at about 375° F for about 30 seconds. The press is opened and the paper and cloth removed and allowed to cool to room temperature. The silicone release paper is peeled from the cloth and in each case revealed a uniform, almost 100 percent transfer of the image to the cloth. Each cloth is then flexed and washed and in each case a permanent image is adhered to the cloth.

EXAMPLES VIII-XII

The process of Examples III-VII is repeated except in each instance the toner image is slightly fused and then overcoated after imaging with the sheets of Examples VIII-XII.

Each of the imaged substrates overcoated with the polymeric sheet is then placed in contact with a woven cloth formed of 25 percent polyester, 75 percent cotton and placed in a heated press at about 350° F for about 30 seconds. The cloth and sheet are removed from the press and allowed to cool. The silicone sheet is stripped from the cloth and a clear, full color image is exhibited on the cloth. Flexing and washing of the cloth do not destroy the image.

EXAMPLE XIII

The silicone coated sheet of Example I is imaged by a Xerox 6500 color copier set to slightly fuse the image. A sheet is formed of Decal-IT, a vinyl chloride latex. The imaged silicone coated sheet was then placed in contact with the vinyl latex sheet which covers a woven cotton cloth and placed in a heated press for about 30 seconds at about 375° F. The cloth and transfer sheet are removed from the press and allowed to cool. The silicone coated sheet is stripped from the cloth and a full color image is found to be transferred to the cloth. Flexing, abrasion, and washing of the cloth do not destroy the image.

EXAMPLE XIV

A silicone coated paper as disclosed in Example I is imaged in a conventional Xerox 6500 color copier without the fuser imaged to form a full color image. A 3 inch diameter stainless steel roll containing an internal heater is maintained at 375° F and lubricated with a coating of low molecular weight polyethylene available from Allied Chemical as AC polyethylene 8 and above described. The silicone coated sheet having the nonfused toner image resting thereon is brought into face-to-face contact with a cloth while a positive corotron is passed over the back of the silicone coated paper. The silicone coated paper is removed leaving a full color image on the cloth. The above described heated stainless steel roller lubricated with low molecular weight polyethylene is brought into pressing contact with an about 3 inch diameter unheated silicone coated roll and both are rotated so that material fed therebetween moves at the rate of about 2 inches per second. The cloth having the toner image resting thereon is fed between the rolls. The toner is not transferred significantly to the polyethylene lubricated roller. Further, the toner material is found to be permanently adhered to the cloth. Washing and flexing of the cloth does not dislodge the image. The low molecular weight polyethylene does not form an undesirable background on the cloth.

EXAMPLE XV

The procedure of Example XIV is repeated except that the silicone paper bearing the toner image is placed in contact with the cloth and then the composite article is passed through the rollers. This results in poor transfer of the toner material to the cloth as the polyethylene cannot contact the toner. Further, the image has a glossy appearance on the cloth and will be flaked off by flexing of the cloth.

EXAMPLE XVI

The composite structure of Example I comprising a cloth, interposed sheet and a silicone coated substrate on which rests a toner image is passed through the rollers of Example XIV with the cloth facing the heated polyethylene lubricated roll. The silicone coated paper is stripped from the cloth and a good image transfer is found to result by this process. The image is of good permanence and resistance to flexing. Further, there is no staining caused by the polyethylene or interposed sheet.

EXAMPLE XVII

A container about 12 inches in diameter and about 20 inches high is filled to a depth of 1 inch with Freon TF (trichlorotrifluoroethane) and held at about 47° C in a suitably hooded work area. A cotton cloth approximately 3 inches × 8 inches has transferred thereto a colored toner image by the process described in Example XIV. The cloth is stapled by the long edge to a narrow piece of wood. The wood is then grasped by tongs and the cloth is suspended slightly above the liquid level for approximately 30 seconds. After withdrawal from the container, the toner is found to be permanently fixed to the cloth by the action of the solvent vapors. Washing does not dislodge the image and there is no discoloration caused by the vapor.

EXAMPLES XVIII-XX

The process of Examples III–V are repeated except a sheet of polyvinyl chloride of about 75 microns thickness is substituted for the cloth material. The image produced is of good quality and is not dislodged by flexing.

EXAMPLES XXI-XXIII

The process of Examples VIII, IX and X is repeated except an about 50 microns thickness sheet of Mylar, a polyethylene terephthalate is substituted for the cloth. The image is found to be almost completely transferred and is not dislodged by flexing.

EXAMPLES XXIV-XXVII

The process of Examples III, IX and X is repeated except an about 75 microns thickness polyethylene sheet is substituted for the cloth. The image is almost entirely transferred and is not dislodged by flexing.

Although specific materials and conditions were set forth in the above exemplary process, in the formation and use of the transfer process and interposed sheets of the invention, these are merely intended as illustrations of the present invention. Various other substituents and processes such as those listed above may be substituted for those in the Examples with similar results. In addition to the steps used in the process of the invention, other steps or modifications may be used if desirable. In addition, other materials may be incorporated into the toners or transfer members of the invention which will enhance, synergize or otherwise desirably effect the properties of these materials for their present use. For example, the transfer of the toner using the interposed web could be performed by a heated roller or rollers rather than by a press. Also the transfer may be carried out by the separate steps of first heating the imaged member, interposed sheet and cloth and then subjecting them to pressure. It is further possible to incorporate elements sensitive to black light, luminscent or reflective, into the toner material or interposed web for formation of safety garments or decorative items.

Other modifications of the present invention will occur to those skilled in the art upon reading of the present disclosure. For instance, it is possible to superimpose several images onto one cloth to obtain interesting effects. The process further is suitable for use with only black toner or toner of a single color rather than full color as set forth in the above Examples. Additionally, the processes of the invention may be carried out with receiving mediums which are not in the form of webs or sheets. The processes of the instant invention may be used to decorate furniture, vinyl car tops, walls, toys or other finished articles. These and other modifications are intended to be included within the scope of the invention.

What is claimed is:

1. A method of decalcomania comprising xerographically providing a toner image resting on an abhesive substrate, overlaying said image with an interposed sheet of polymeric plasticizing material, placing an image receiving medium in contact with said interposed sheet and applying heat and pressure to the composite formed by said image receiving medium, interposed sheet and said image bearing substrate to form a permanent image on said image receiving medium.

2. The method of claim 1 wherein said image receiving medium comprises cloth.

3. The method of claim 2 wherein said interposed sheet comprises a polymeric material selected from the group consisting of methacrylate-n-butylmethacrylate copolymers, polyvinyl acetate homopolymer emulsions, vinyl chloride homopolymer latexes, vinyl chloride acrylate latexes and combinations thereof.

4. The method of claim 2 wherein said cloth is selected from materials of cotton, polyester and blends thereof.

5. The method of claim 1 wherein said toner image pattern is in full color formed by sequential developing with toners of three colors.

6. The method of claim 1 wherein said interposed sheet is transparent.

7. The method of claim 1 wherein the interposed sheet is applied to the toner image on an abhesive coated support to create an integral composite.

8. The method of claim 1 wherein said interposed sheet further comprises a colorant.

9. The method of claim 1 wherein said medium comprises a polymeric sheet.

10. A method of decalcomania comprising xerographically forming an image pattern of toner, transferring said toner to an image receiving medium and passing said medium bearing said toner image under a heated roll to which has been applied plasticizer for the toner material in order to apply said plasticizer from said roll to said toner material to fix said image to said medium.

11. A method of claim 10 wherein said plasticizing material is selected from the group consisting of esters, paraffins, phenoxy plasticizers, phthalate acid derivatives, oleates, stearates and mixtures of these materials and said image receiving medium is cloth.

12. The method of claim 10 wherein said plasticizing material is a low molecular weight polyethylene and said image receiving medium is cloth.

13. The method of claim 10 wherein said roller is maintained at about 375° F.

14. A method of decalcomania comprising xerographically forming an image pattern of toner, transferring said toner to an image receiving member, overlaying said toner with a polymeric plasticizing sheet and applying heat and pressure to permanently transfer said image to said member.

15. The method of claim 14 wherein said member comprises cloth.

16. The method of claim 14 wherein said member comprises a polymeric sheet.

* * * * *